US008387856B1

(12) United States Patent
Lachance et al.

(10) Patent No.: US 8,387,856 B1
(45) Date of Patent: Mar. 5, 2013

(54) PACKAGING BOX WITH HINGED PANEL

(76) Inventors: John Lachance, Thompson, CT (US); Giovanni C. Meier, Madison, CT (US); Gintaras A. Vaisnys, Chicago, IL (US)

( * ) Notice: Subject to any disclaimer, the term of this patent is extended or adjusted under 35 U.S.C. 154(b) by 470 days.

(21) Appl. No.: 12/658,255

(22) Filed: Feb. 4, 2010

(51) Int. Cl.
*B65D 5/50* (2006.01)
*B65D 5/66* (2006.01)

(52) U.S. Cl. ..... 229/123; 206/738; 206/754; 206/757; 206/766; 229/130; 229/146

(58) Field of Classification Search ..... 229/122, 229/123, 130, 146, 178; 206/45.29, 737, 206/738, 751, 754, 757, 759, 762, 766
See application file for complete search history.

(56) References Cited

U.S. PATENT DOCUMENTS

| | | | | | |
|---|---|---|---|---|---|
| 1,859,401 | A | * | 5/1932 | Lengsfield | 206/751 |
| 1,909,472 | A | * | 5/1933 | Keppler | 206/45.29 |
| 1,983,689 | A | * | 12/1934 | Bedell | 229/146 |
| 2,322,849 | A | * | 6/1943 | Horr | 206/45.29 |
| 2,464,904 | A | * | 3/1949 | Tomarin | 229/123 |
| 3,520,409 | A | * | 7/1970 | Gibbs, Sr. | 229/123 |
| 4,151,946 | A | * | 5/1979 | Schmidt et al. | 229/123 |
| 4,295,599 | A | * | 10/1981 | Locatelli et al. | 206/737 |
| 4,317,536 | A | * | 3/1982 | Dickerson | 229/130 |
| 4,732,269 | A | * | 3/1988 | Roy | 206/751 |
| 4,896,766 | A | * | 1/1990 | Paley | 206/754 |

* cited by examiner

*Primary Examiner* — Gary Elkins

(57) ABSTRACT

A shipping box is disclosed having a rotatable panel associated with the lid. The rotatable panel allows the hinge of the shipping box to be displaced outwardly from the box. As a result, the shipping box can contain a display box that can be opened while in the shipping box, without increasing the size of the shipping box.

2 Claims, 10 Drawing Sheets

PACKAGING BOX WITH HINGED PANEL

TECHNICAL FIELD

The present invention relates to packaging, and, more specifically, to a box having a rotatable panel associated with a lid.

BACKGROUND OF THE INVENTION

Packing of goods for shipment generally requires that the goods be put into a shipping container. A common shipping container is a shipping box made from corrugated cardboard, which is designed based on what is contained therein to withstand the rigors of shipping, such as by common carriers.

Corrugated cardboard shipping boxes can be obtained in many shapes, but are generally rectangular solids. Where numerous shipping boxes are obtained for a single product, the shipping box is usually designed around the product, or the display packaging in which the product is placed. More specifically, the shipping box is generally of a custom size based on the specific characteristics of the product (or display packaging), such as size, weight and frigility (e.g., a stronger box using heavier cardboard would be used for a fragile item).

The use of a custom sized shipping box reflects the need on the part of the shipper to minimize shipping costs. Reductions in cubic volume increase packing efficiency by allowing for more shipping boxes to be placed in a given volume, such as a shipping container. Reductions in cubic volume also reduce weight and cost by minimizing both shipping box material and stuffing material (e.g., Styrofoam peanuts).

Many of the above considerations are also used in designing display packaging. Display packaging, however, is generally not designed to withstand the rigors of shipping. One type of packaging particularly unsuited for shipping is commonly referred to a clamshell packaging (e.g., a two-piece, hard plastic container having a highly contoured, non-rectangular-solid shape).

Where the display packaging must interact with the shipping packing additional considerations in the design of the shipping box are required. For example, one particular interaction is the opening of the display packaging to view the product without removal of the display packaging from the shipping packaging. In another example, the display packing is opened to allow removal of the product.

Where this is required, the shipping packaging is oversized to accommodate any necessary space for movement of the display packaging. More specifically, the lid of the display packaging may be connected to the balance of the display packing by a hinge. When the lid is opened, the lid rotates about the hinge causing a change in the volume that the lid occupies. If there is insufficient space in the shipping packaging to allow for the necessary movement of the lid, some part of the lid will contact the shipping package. Oversizing of the shipping packaging to meet this need increases both the cost of the shipping container and any stuffing material that would be required.

What is need in the art is a shipping container that will interact with a product, or product display packaging, in a more efficient manner, such that the shipping container can be reduced in volume.

Furthermore, other desirable features and characteristics of the present invention will become apparent for the subsequent detailed description of the invention and the appended claims, taken in conjunction with the accompanying drawings and this background of the invention.

SUMMARY OF THE INVENTION

The invention is a shipping box having a rotatable panel associated with the lid. The rotatable panel allows the hinge of the shipping box to be displaced outwardly from the box. As a result, the shipping box can contain a display box that can be opened while in the shipping box, without increasing the size of the shipping box.

Other features, attainments, and advantages will become apparent to those skilled in the art upon a reading of the description when taken in conjunction with the accompanying drawings.

DETAILED DESCRIPTION

Figure 1:
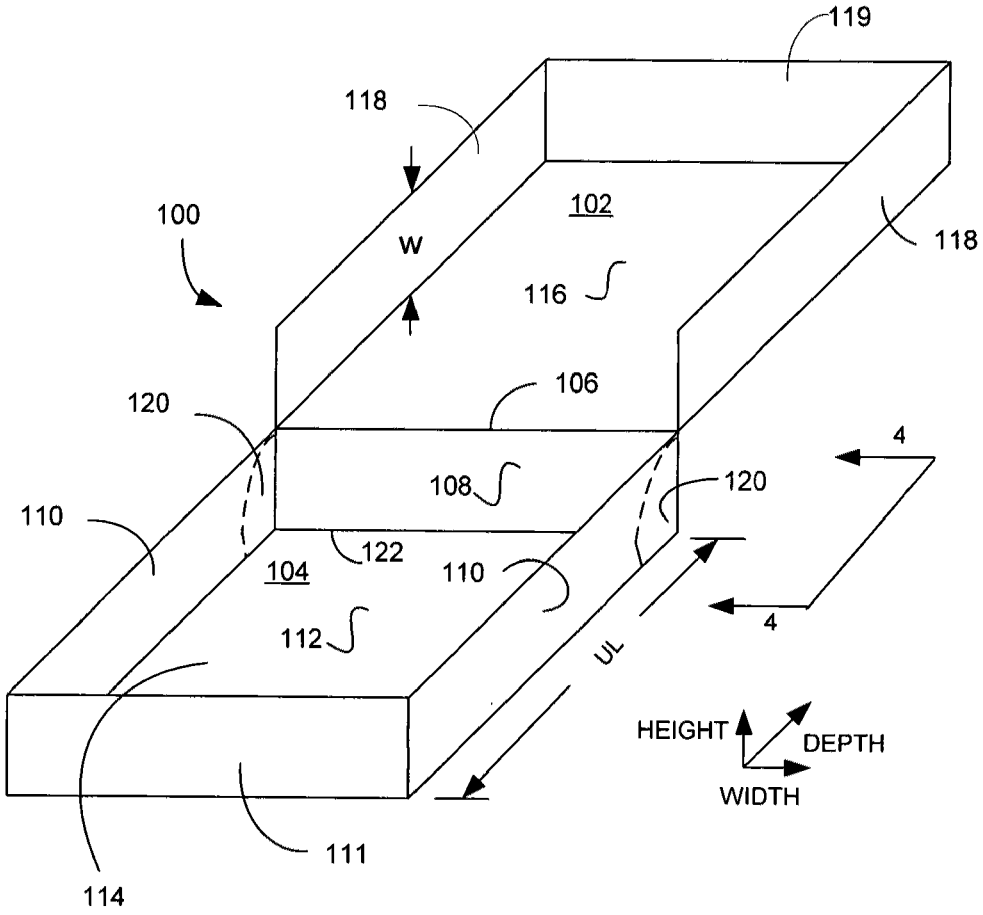
FIG. 1 is a side perspective drawing of a shipping box of the present invention in a first configuration.

As shown in FIG. 1, a shipping box (generally referred to by reference no. 100) has a lid 102 and a container 104. The lid 102 rotates about a hinge 106 to close the container 104. The hinge 106 is attached to a hinge panel 108, which forms a portion of the perimeter of the container 104. The hinge panel 108 in association with side panels 110, front panel 111, and base 112 define a volume 114.

The lid 102 includes a top panel 116 that has connected thereto flaps 118, 119. The side flaps 118 are connected at the sides of the top panel 116, while the front flap 119 is connected to the top panel between the two side panels. When the top 102 is rotated about the hinge 106 to close the shipping box, the flaps 118, 119 go into the volume 114. As illustrated, the flaps 118 have a width w such that when the shipping box 100 is closed, edges of the flaps 118 rest on the base 112, such that the top panel 116 is generally parallel to the base.

Figure 2:
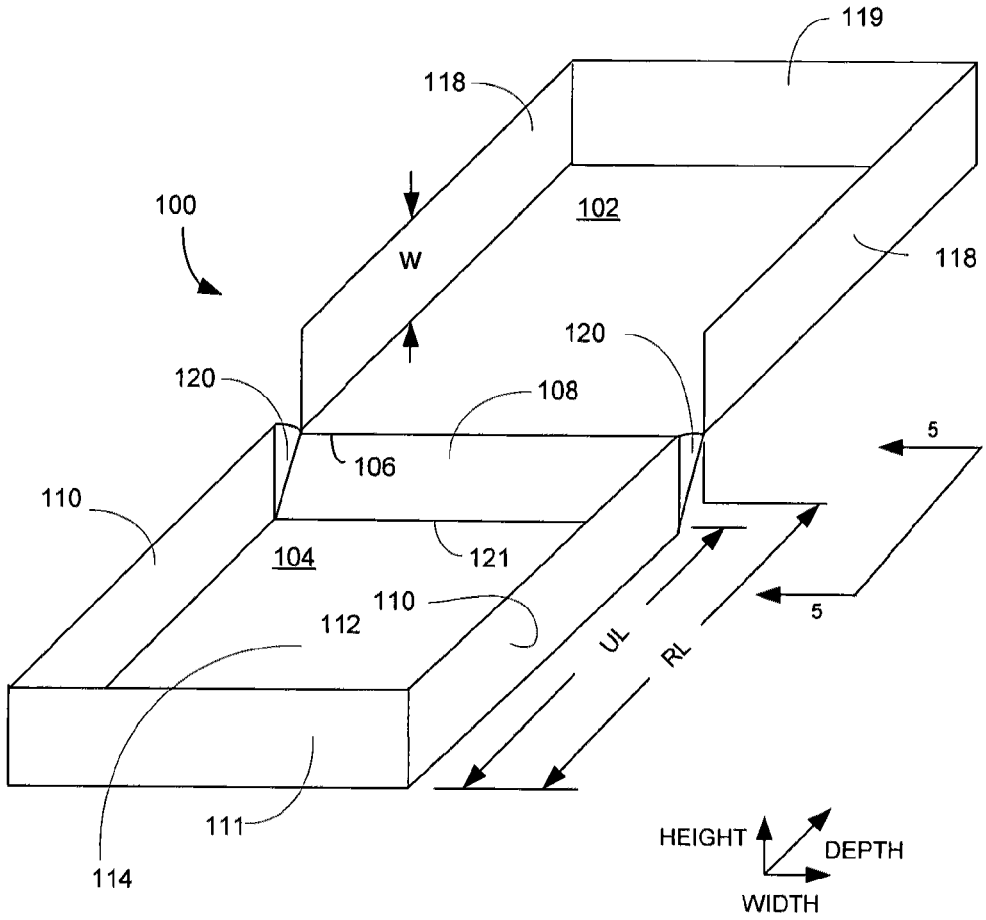
FIG. 2 is the same side perspective drawing of the shipping box of FIG. 1, but in a second configuration.

The shipping box further includes a pair of cooperating hinge tabs 120. The hinge tabs 120 are connected to the hinged panel 108. As shown in FIGS. 1 and 2, the hinge tabs 120 allow the hinged panel 108 to rotate about an axis 121, which is between the hinged panel 108 and the base 112. The details of the hinge tabs 120 are discussed below.

The hinge tabs 120 give the shipping box 100 two depths. When the hinge panel 106 is in the up position, the shipping box 100 has an up depth UL. When the hinge panel is rotated, the shipping box 100 has a rotated depth RL, which is longer than then the up depth UL. Both depths are measure from the front of the shipping box 100 to the point where the hinge 106.

Figure 3:
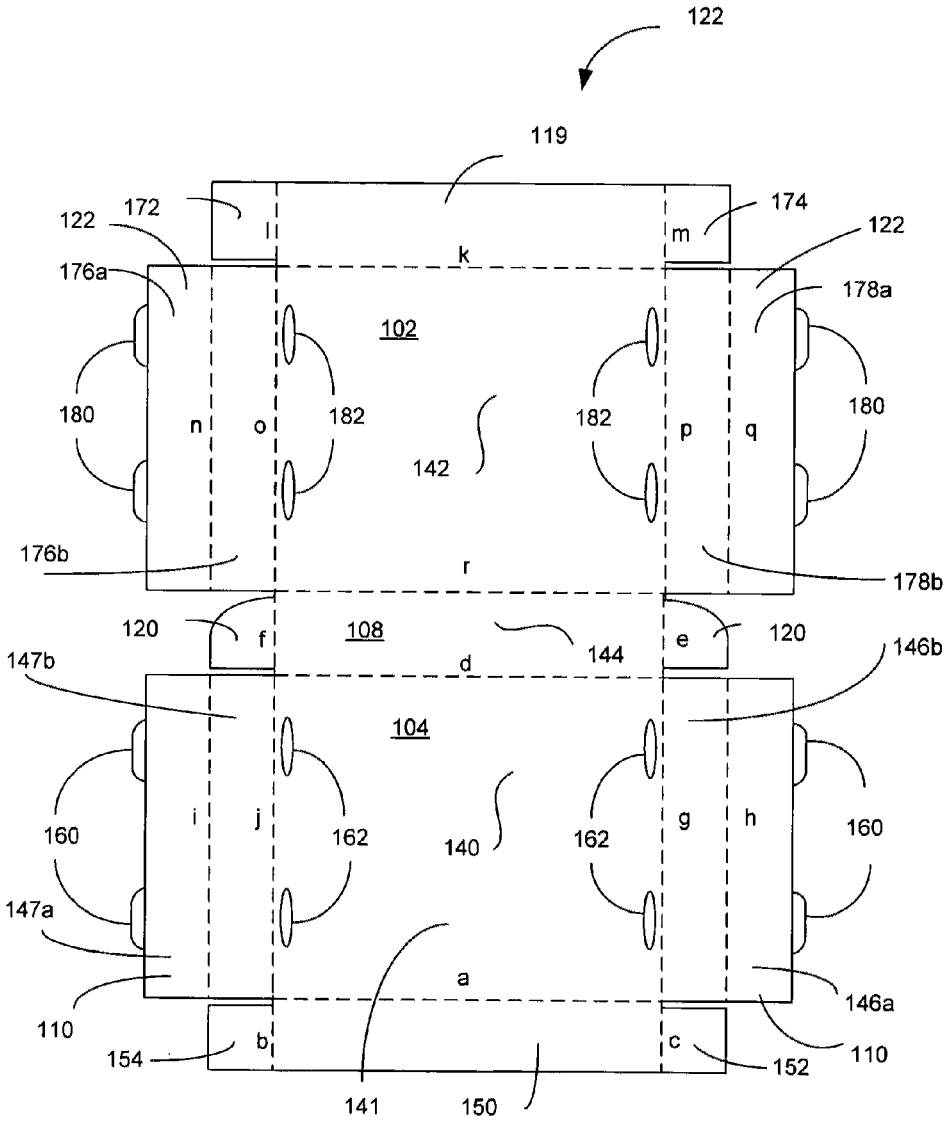
FIG. 3 is a top view drawing of a shipping box blank.

FIG. 3 is a shipping box blank 12. A box blank 122 is a flat piece of cardboard that can be folded into a three dimensional box along. The dotted lines indicate fold lines. The illustrated blank 122 is for the shipping box 100 shown in FIG. 1.

The shipping box blank 122 has a bottom portion (generally referred to by reference no. 140) and a top portion (generally referred to by reference no. 142). The bottom portion 140 is connected to the top portion 142 by a hinge portion 144. The bottom portion 140 includes a bottom panel 141, side sections 146, 148, and front section 150, which has tabs 152, 154. To construct the bottom 104 of the shipping box 100, the front section 150 is folded upward along line a and the tabs 146,148 are folded along line b and c toward the hinge portion 144.

Next, the hinge portion 144 and hinge tabs 120 make up the hinge panel 102. The hinge portion 144 is folded upward along line d and the hinge tabs 120 are folded about lines e and f toward the front section 150. With the hinge tabs 120 and the tabs 152, 154 perpendicular to the bottom portion 140 and extending down lines g and h, the side sections 146*a, b* and 148*a, b* are folded along lines i and j with tabs 160 inserting into slots 162. The folding of the side sections 146, 148 creates channels, discussed below, wherein each channel confines a hinge tab 120 and a tab 152, 154.

The top 102 of the shipping box 100 is completed by folding the top portion 142. More specifically, a front panel 170 is folded about line k with tabs 172, 174 being folded along lines I and m. Next side panels 176, 178 are folded about their respective lines m and n, and o and p, whereby tabs 180 engage slots 182, trapping the tabs 172, 174 in their respective channels, which were formed as a result of folding the side flaps 176, 178.

Figure 4:
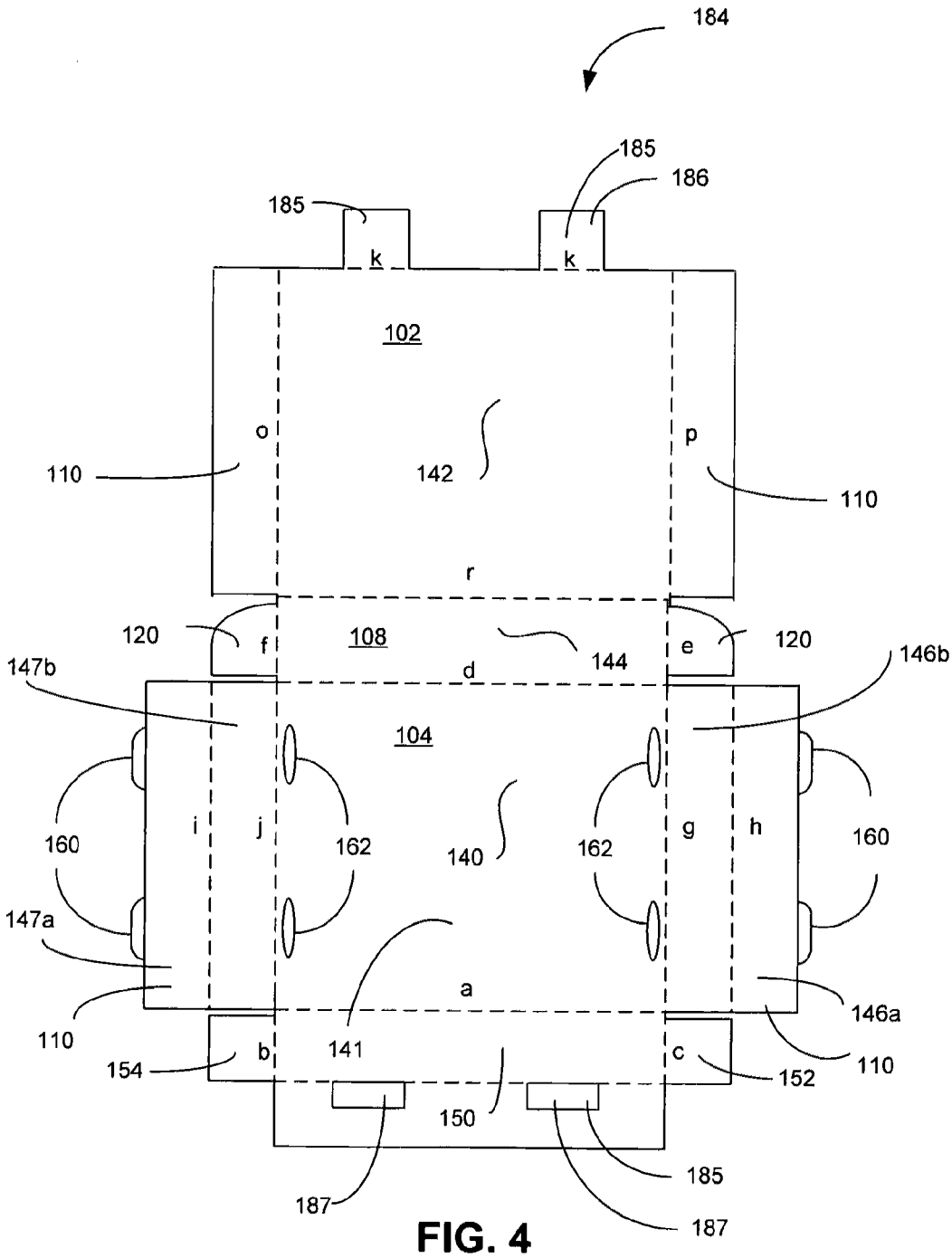
FIG. 4 is a top view drawing of another shipping box blank.

FIG. 4 is another shipping box blank (generally referred to by reference no. 184, and using common numbering for similar elements with shipping box blank 122). For this shipping box 184, the front flap 119 incorporates a latch 185. In this example, the fastener 185 is of the tab and slot type having a pair of tabs 186 that are inserted into cooperating slots 187 in the front panel 111. The fastener 185 secures the hinge panel 108 in place when the lid 102 is closed. As those skilled in the art will appreciate, this is but one type of fastener and many other fastener types, such as string and button, hook and loop, and exterior top flaps, could be used. Where the fastener is to be reusable, the fastener should be reusable.

Figure 5:
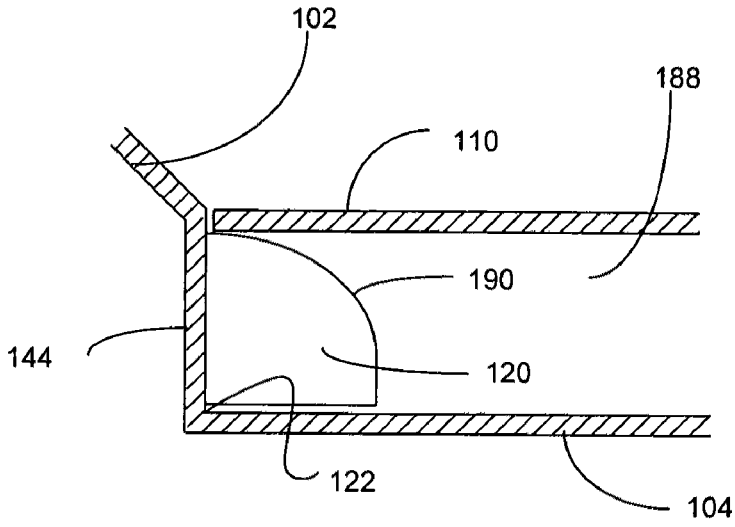
FIG. 5 is a side view drawing taken along line 4-4 in FIG. 1.
Figure 6:
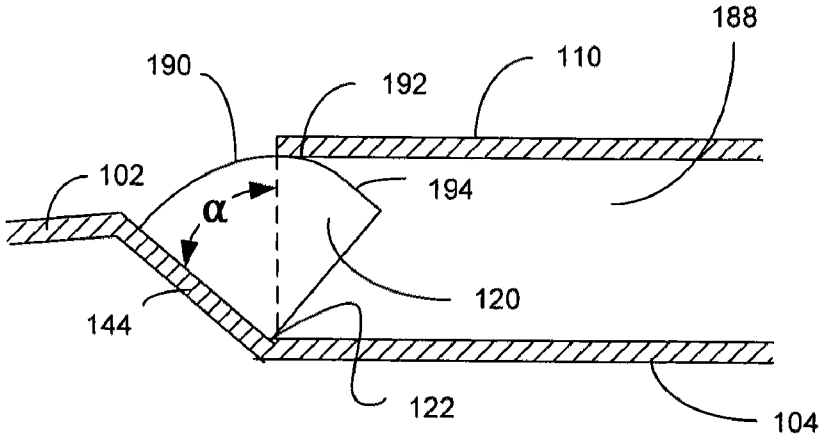
FIG. 6 is a side view drawing taken along line 5-5 in FIG. 2

As shown in FIGS. 5 and 6, the hinge tabs 120 are within a channel 188. The hinge tab 120 has a contoured surface 190, which in this illustrative example is a curved surface, permitting the hinge tab to rotate about line d to move between a first position (FIG. 5), and a second position (FIG. 6), which is at an angle $\alpha$. The angle $\alpha$ is the angle between the first position and the second position where the first position is zero.

In the first position, the hinge panel 144 is generally at an angle relative to the bottom panel such that the top of the box properly mates with the bottom of the box. As illustrated, the hinge panel 144 is perpendicular to the bottom panel, or the angle $\alpha$ is zero.

In the second position, the angle $\alpha$ is greater than zero. As illustrated, each hinge tab 120 has a stop 192 that fixes the maximum angle $\alpha$. The illustrated stop 192 is created by the cooperation of the curved side 190 and a second side 194 of the hinge tab 120. As discussed above, the curved side 190 permits the hinge tab 120 to exit the channel 188, thereby permitting the hinge panel 108 to rotate. The second side 194 effectively increases the radius such that it is greater than the radius of the curved side 190. As a result, the radius in the area of the second side 194 is greater than the height of the channel 188 causing the stop 192 to impact the channel 188. As those skilled in the art will appreciate, this type of stop is easily made during the cutting of the box blank, but other stops could be used.

In this illustrative example, the hinge tab 120 has a root (i.e., the portion of the hinge tab that connects to the hinge portion 144). As illustrated, the root is full-size in that it extends the maximum height permitted. As a result, the height of the stop is below the top of the root. While a curve surface between the top of the root and the stop has been illustrated, other contours, such as linear, are possible. In addition, the top of the root could be lowered.

Figure 7:
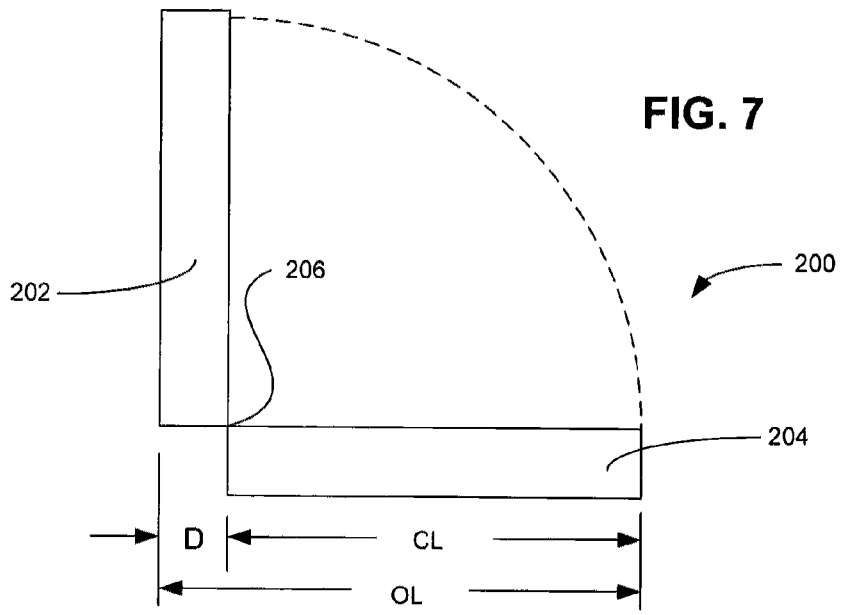
FIG. 7 is a side view drawing of a display box in the open position.
Figure 8:
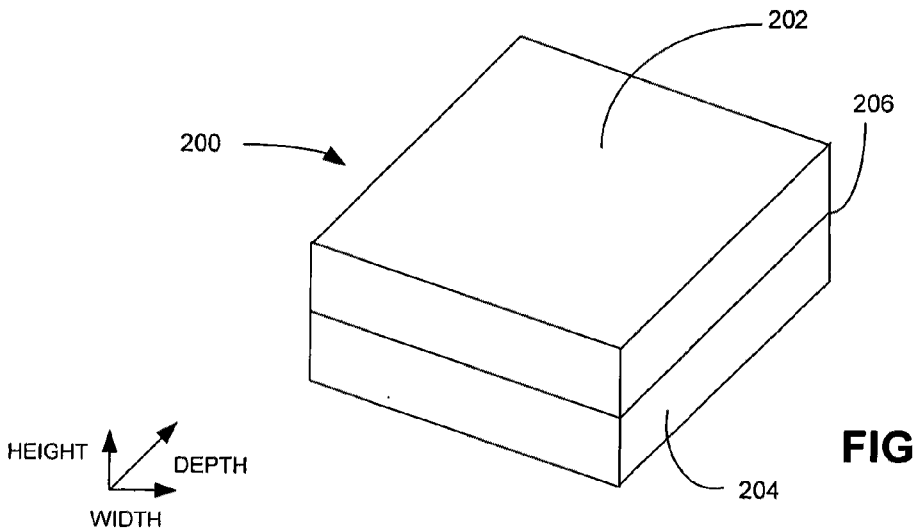
FIG. 8 is a side perspective view of the display box shown in FIG. 7 in the closed position.

FIGS. 7 and 8 illustrate a display box 200 for use with the shipping box 100. As illustrated, the display box 200 has a top portion 202 and a bottom portion 204 that are connected by a hinge 206. The top portion 202 and the bottom portion 204 each have a width, such that there is a displacement D of the hinge from the top of the top portion. The displacement D of the hinge 206 causes an offset O when the top is opened. Thus, the display box 200 has two lengths, a closed depth CL and a longer open depth OL.

Figure 9:
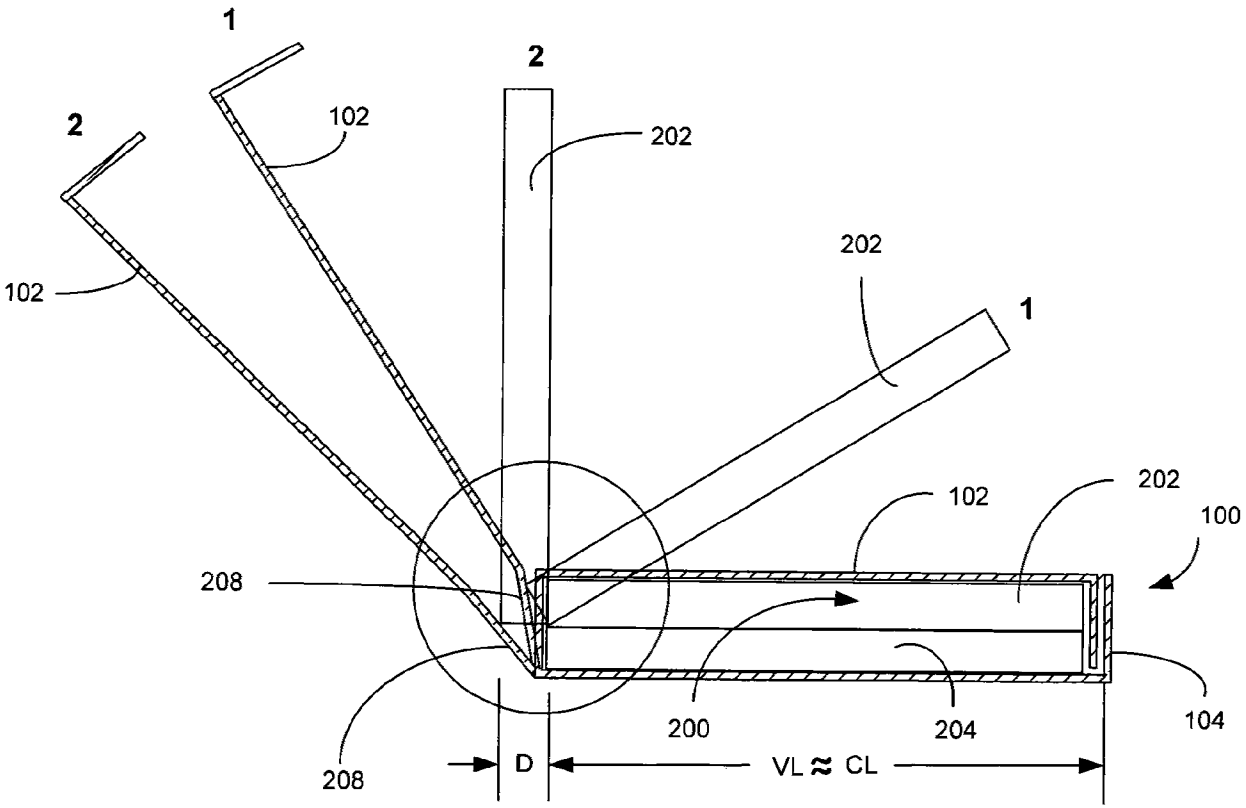
FIG. 9 is a side cutaway drawing of the shipping box of FIG. 1 with a display box therein.
Figure 10:
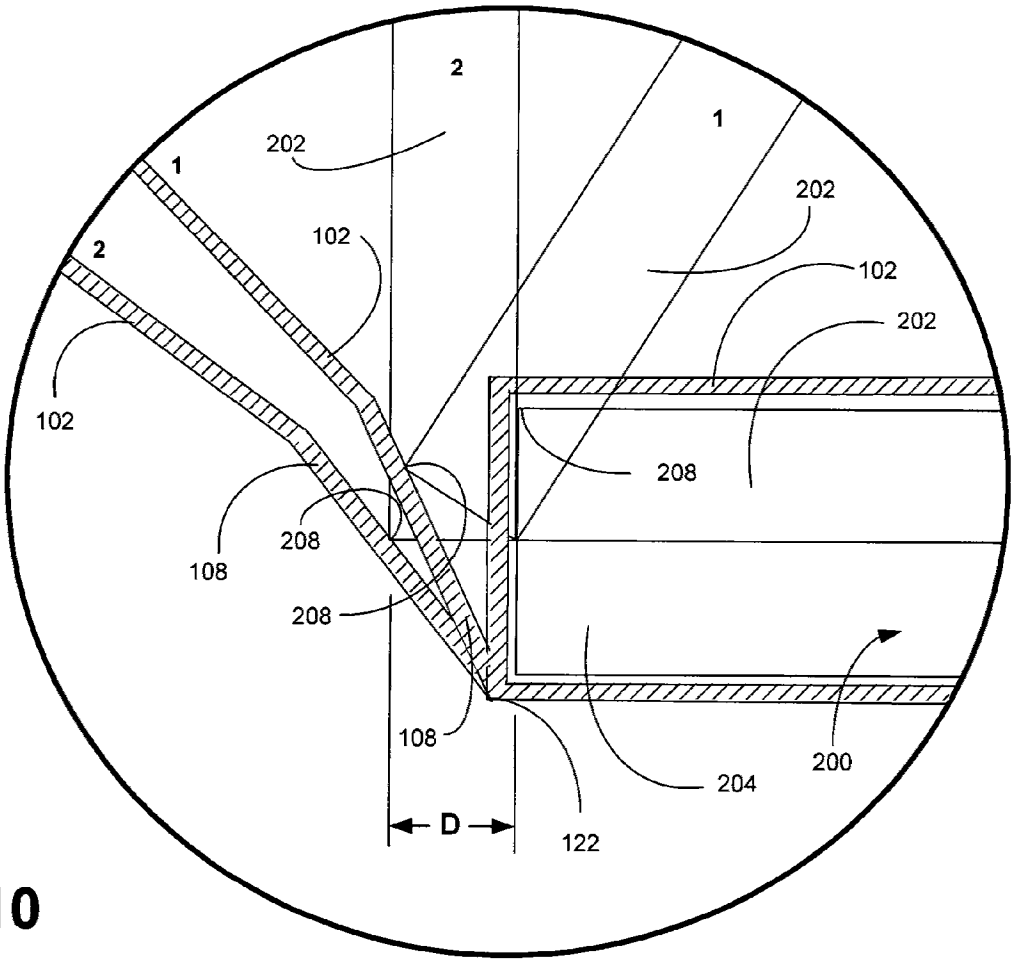
FIG. 10 is an expanded side view of the shipping box with display box therein of FIG. 9 taken along line 9-9 of FIG. 9.

As shown in FIGS. 9 and 10, when the display box 200 is placed in the shipping box 100, the display box and the shipping box interact such that the size of the shipping box can be reduced. More specifically, the display box 200 has a closed depth CL (see FIG. 8), which is approximately the inside depth of the shipping box 100, which is VL (see FIG. 2).

After placement of the display box 200 in the shipping box 100, the lid 202 of the display box can be opened. Referring to FIG. 10, as the lid 202 of the display box 200 is opened, an edge 208 of the display box comes into contact with the hinge panel 108 of the shipping box 100. As the display box lid 202 continues to be opened (moving from position 1 to 2), the lid forces the hinge panel 108 to rotate about its axis 121. This rotation will continue until the stop 192 (see FIG. 6) prevents it. Ideally, the display lid 202 should reach a point where items inside the display box 200 can be removed, or it should be at least vertical.

Figure 11:
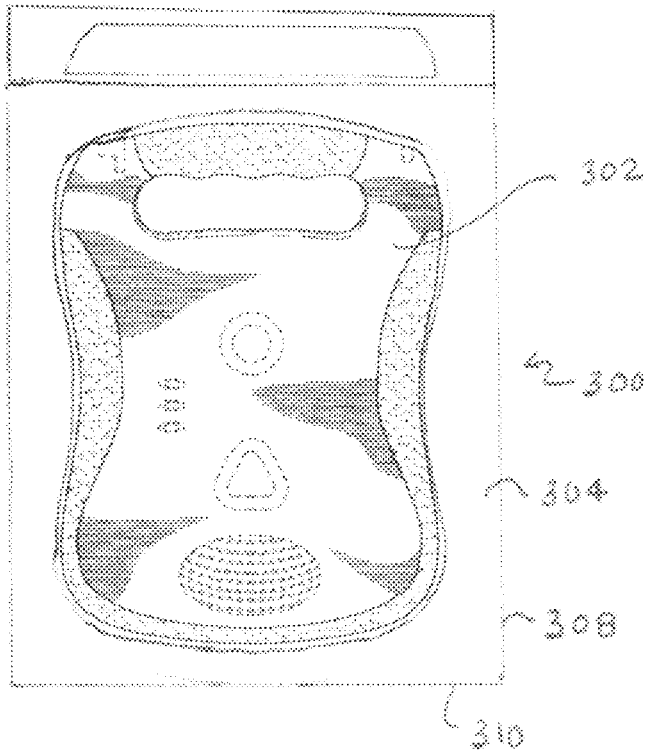
FIG. 11 is a top view drawing of a second display box holding an automated external defibrillator.
Figure 12:
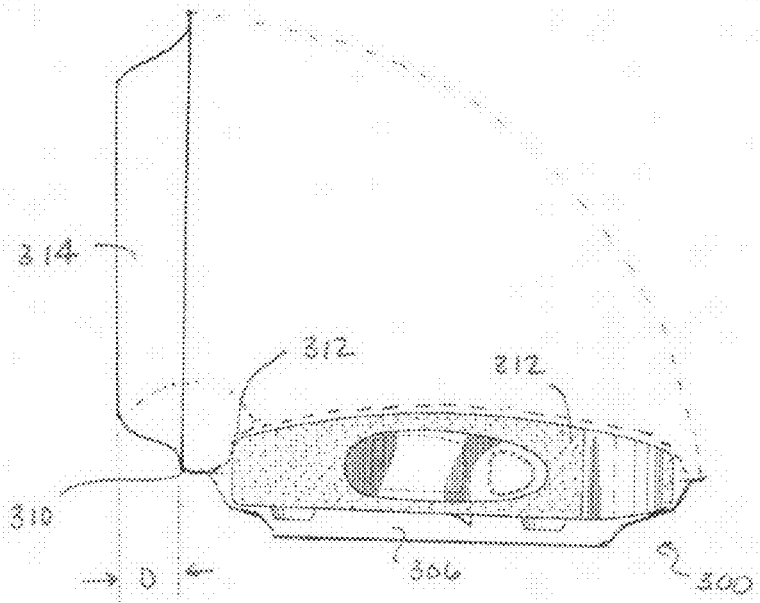
FIG. 12 is a side view drawing of the second display box of FIG. 11.
Figure 13:
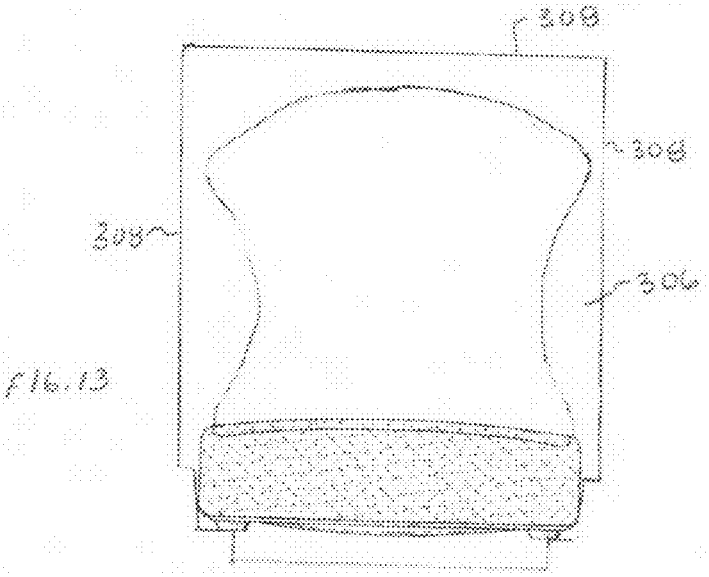
FIG. 13 is an end view drawing of the second display box of FIG. 11.

FIGS. 11 through 13 are various views of a second display box (generally referred to by reference no. 300) holding an automated external defibrillator 302. This second display box 300 is of a style commonly referred to as a clamshell. Typical clamshell packaging has a top 304 and bottom 306 that meet at a seam 308. For closure, the seam may be welded, or the top 304 and bottom 306 may have a fastener system. In some cases, the top 302 and bottom 304 may employ a hinge 310. When a hinge 310 is used, the fastener system may be temporary, allowing the top 304 to be opened and closed.

The top 304 and the bottom 306 of clamshell packaging, have been molded to accept except an item. The shipping box for a clamshell packaged item, may be sized such the further packing material is not required. More specifically, the clamshell is sized such that it fits precisely in the shipping box, thus there is no, or minimal movement, of the clamshell in the shipping box.

As shown in FIG. 12, a clamshell having a hinge 310 has an offset D, just as does the display box (see FIG. 7). The only significant difference is that that the contact point 312 is displaced away from the hinge. More precisely, the contact point 312 is moved toward the front of the clamshell. As a result, the top 304 of the clamshell 300 will not contact a shipping box as soon as it otherwise might if the contact point were positioned approximately perpendicularly above the hinge 310.

Because numerous modifications may be made of this invention without departing from its spirit, the scope of the invention is not limited to the illustrated embodiments.

What is claimed is:

1. A shipping box and display box combination comprising:

a shipping box including a container having a hinge panel which is rotatable about an axis, and a lid, the lid connected by a hinge to the hinge panel such that the hinge operates generally parallel to the axis, and a display box, the display box having a top and a bottom connected by a hinge and the display box is dimensioned to be enclosed in the container, wherein when the display box hinge is placed proximate the hinge and the display box top moves from a first position to a second position, the display box causes the hinge panel to rotate.

2. The shipping box and display box combination of claim 1 wherein the container has a side and the hinge panel has a hinge tab, the hinge tab having a stop, the hinge tab interacting with the side such that the stop limits the hinge panel rotation about the axis.

* * * * *